United States Patent [19]

Andrus et al.

[11] 4,376,031

[45] Mar. 8, 1983

[54] APPARATUS FOR ELECTROPHORETIC DEPOSITION

[75] Inventors: James E. Andrus, Cranbury; Kenneth W. Hang, Princeton Junction, both of N.J.

[73] Assignee: RCA Corporation, New York, N.Y.

[21] Appl. No.: 363,801

[22] Filed: Mar. 31, 1982

[51] Int. Cl.[3] ..... C25B 7/00

[52] U.S. Cl. ..... 204/299 EC; 204/275

[58] Field of Search ..... 204/299 EC, 275, 237, 204/300 R, 300 EC

[56] References Cited

U.S. PATENT DOCUMENTS

| | | | |
|---|---|---|---|
| 1,907,984 | 5/1933 | Kraner . | |
| 2,400,576 | 5/1946 | Sigmund et al. | 204/182 |
| 2,447,270 | 8/1948 | Olsen | 204/237 |
| 3,211,639 | 10/1965 | McNeill et al. | 204/299 EC |
| 3,219,571 | 11/1965 | Parent, Jr. et al. | 204/299 |
| 3,254,004 | 5/1966 | Jackson et al. | 204/15 |
| 3,498,905 | 3/1970 | Strickler | 204/299 |
| 3,654,124 | 4/1972 | Lusk | 204/299 |
| 3,853,736 | 12/1974 | Harnden et al. | 204/275 X |
| 4,162,955 | 7/1979 | Schregenberger | 204/299 |

*Primary Examiner*—G. L. Kaplan
*Assistant Examiner*—N. Nguyen
*Attorney, Agent, or Firm*—Birgit E. Morris; Edward J. Sites

[57] ABSTRACT

An apparatus for electrophoretically depositing a coating on an article is disclosed which includes a tank for holding a supply of the suspension of the material which is desired to be deposited on the article, a holding means for supporting the article in the suspension and providing a voltage of a first polarity to the article which will attract the particles from the suspension, a pair of electrodes adapted to be suspended into the suspension and which can be supplied to the article being coated, and a distribution means for supplying and circulating the suspension within the apparatus in a smooth, laminar, non-turbulent manner. The distribution means includes a manifold for introducing the suspension uniformly within the apparatus and guide plates for guiding the suspension into the tank below the surface of the suspension in a laminar flow pattern without causing turbulence.

5 Claims, 4 Drawing Figures

APPARATUS FOR ELECTROPHORETIC DEPOSITION

This invention relates to an apparatus for the electrophoretic deposition of a coating on an article and, more particularly, is concerned with an electrophoretic deposition apparatus which promotes improved laminar flow characteristics of the suspensions employed for the deposition, so as to provide more uniform coatings on the article.

BACKGROUND OF THE INVENTION

Electrophoresis, in general, relates to the phenomenon which occurs when charged particles suspended in a liquid carrier medium are subjected to an electrical field, and the particles are forced to migrate in one direction or another, depending upon the strength of the electrical field and the mobility of the charged particles. Using the principles of electrophoresis, it is possible to deposit a coating on an article by causing charged particles in a suspension to migrate toward and become electrically attached to the surface of the article.

Electrophoretic deposition of particulate materials to form coatings is currently used in a wide variety of industrial applications, such as in the manufacture of enamelled ironware, in applying paint and rubber coatings to metal and plastic articles, in the formation of dielectric coatings on electrical devices, and in other similar industrial processes. Electrophoretic deposition has many advantages over other conventional methods of applying coatings, such as spraying, dipping, brushing, and the like, in that the coating is deposited more effectively with regard to the full utilization of the material in the suspension, as there is substantially no waste of particulate materials; and, the electrophoretically applied coating is generally more uniform in thickness and in density.

One of the principal industrial uses of electrophoretic deposition is to form glass or porcelain coatings on sheet metal articles, such as sheet steel. The resulting glass or porcelain coating formed on the metal articles can be used to protect the underlying metal from corrosion, or to provide a dielectric coating on the surface of the metal article so that it can be used as a substrate on which to assemble electrical devices. In view of the relative commercial importance of forming the glass or porcelain coatings on sheet metal articles, the further description of the invention will be specifically directed toward this application. However, it should be appreciated that the apparatus of this invention can likewise be used with various shaped articles to provide improved coatings in a similar manner.

In the electrophoretic deposition of glass or porcelain-forming materials on a sheet metal article, the initial step is the preparation of a suspension of finely divided glass or porcelain-forming particles in a liquid medium such as water or alcohol. The sheet metal article to be coated is then positioned in the suspension and connected to a cathodic or anodic voltage source. Electrodes are positioned in the suspension adjacent to, but spaced apart from, the article to be coated and are connected to a source of voltage of the opposite polarity to that supplied to the article. When a voltage is applied across the suspension between the article and the electrodes, the particles of the glass or porcelain-forming frit will migrate toward the article to be coated and adhere to the surface of the sheet metal article because of the differences in the polarity of the particles and the sheet metal article. When the desired amount of glass or porcelain-forming frit has adhered to the surface of the article, the deposition process is discontinued and the coated article is removed from the suspension. Normally, thereafter, the coated article is given an additional treatment, such as being fired in the case of glass or porcelain-forming frits, to improve the adhesion of the coating to the surface of the sheet metal article.

In the electrophoretic deposition of coatings using conventional electrophoretic deposition apparatus, a number of problems which are encountered result in unsatisfactory electrophoretically deposited coatings being obtained. One such problem is the lack of uniformity of the deposited coating. The coating which is deposited should be as uniform in thickness as possible for most applications. This is particularly true when the coated substrate is a metal substrate coated with porcelain which will be used as a substrate to support electronic devices, as it is important to have uniform dielectric protection across the entire surface of the substrate. However, certain problems are encountered with the prior art electrophoretic deposition apparatuses, which lead to variations in the thickness of the coating on the article, particularly at the edges.

It was recognized in the art that the suspension comprised of the particulate material and the liquid medium should be as quiescent as possible in the electrophoretic zone, that is, in the zone between the article and the electrodes of the opposite polarity, in order to obtain as uniform a deposit of the particulate material as possible. However, since the suspension is constantly changing in composition because of the removal of particles from the suspension as they are deposited on the article, and also as a result of some separation of the particles from the suspension, it is impossible to maintain a consistent composition of the suspension without circulating the suspension and reconstituting it as required because of the depletion and settling of the particulate material from the suspension. The required circulation of the suspension through the electrophoretic deposition apparatuses of the prior art has caused considerable problems with regard to the uniformity of the application of the coatings as a result of the flow patterns and the disruption of the surface area of the suspension as a result of the fluid movement of the suspension through the apparatus. The problems caused by the circulation of the suspension through the apparatus are particularly evident in certain of the apparatus disclosed in the prior art at the area immediately adjacent the surface of the suspension in the apparatus, in that at these areas rough uneven coatings are commonly obtained because of the variations and the movement of the suspension in these areas.

The circulating suspension should preferably be introduced into the apparatus close to the article to be coated, in a smooth laminar flow, without causing any substantial surface or internal turbulence within the apparatus.

Accordingly, what would be highly advantageous would be an electrophoretic deposition apparatus which included means for improving the circulation of the suspension through the apparatus so as to obtain a smooth, uniform, laminar flow without causing any significant amount of surface or internal turbulences.

SUMMARY OF THE INVENTION

An apparatus for electrophoretically depositing a coating on an article is disclosed which includes a tank for holding a supply of the suspension of the material which is desired to be deposited on the article, a holding means for supporting the article in the suspension and providing a voltage of a first polarity to the article which will attract the particles from the suspension, a pair of electrodes adapted to be suspended into the suspension and which can be supplied with a voltage of the opposite polarity to that supplied to the article being coated, and a distribution means for supplying and circulating the suspension within the apparatus in a smooth, laminar, non-turbulent manner. The distribution means includes a manifold for introducing the suspension uniformly within the apparatus and guide plates for guiding the suspension into the tank below the surface of the suspension in a laminar flow pattern without causing turbulence.

DETAILED DESCRIPTION OF THE INVENTION

Figure 1:
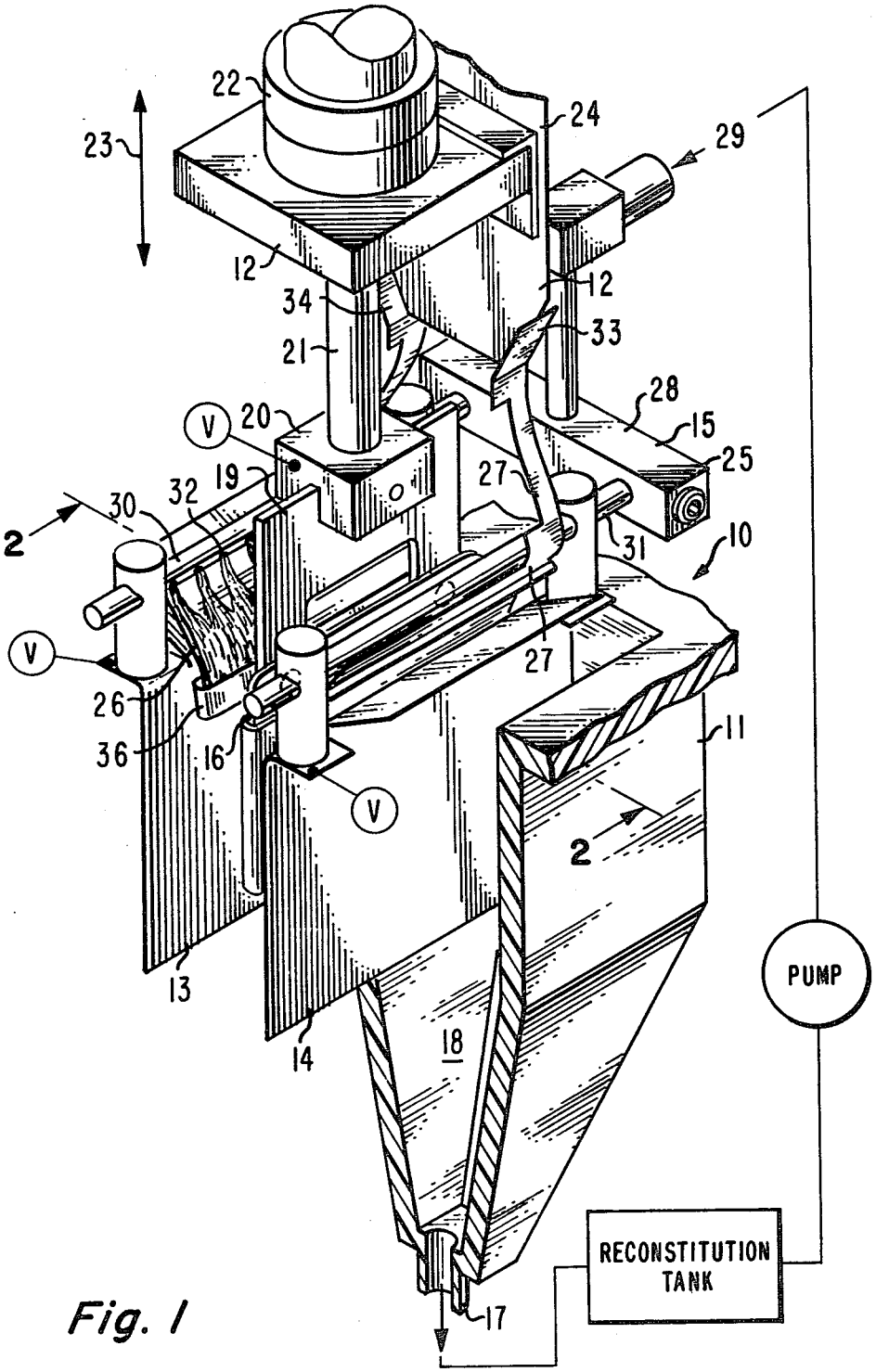
FIG. 1 is an isometric illustration in partial cross-section of the apparatus of this invention.
Figure 2:
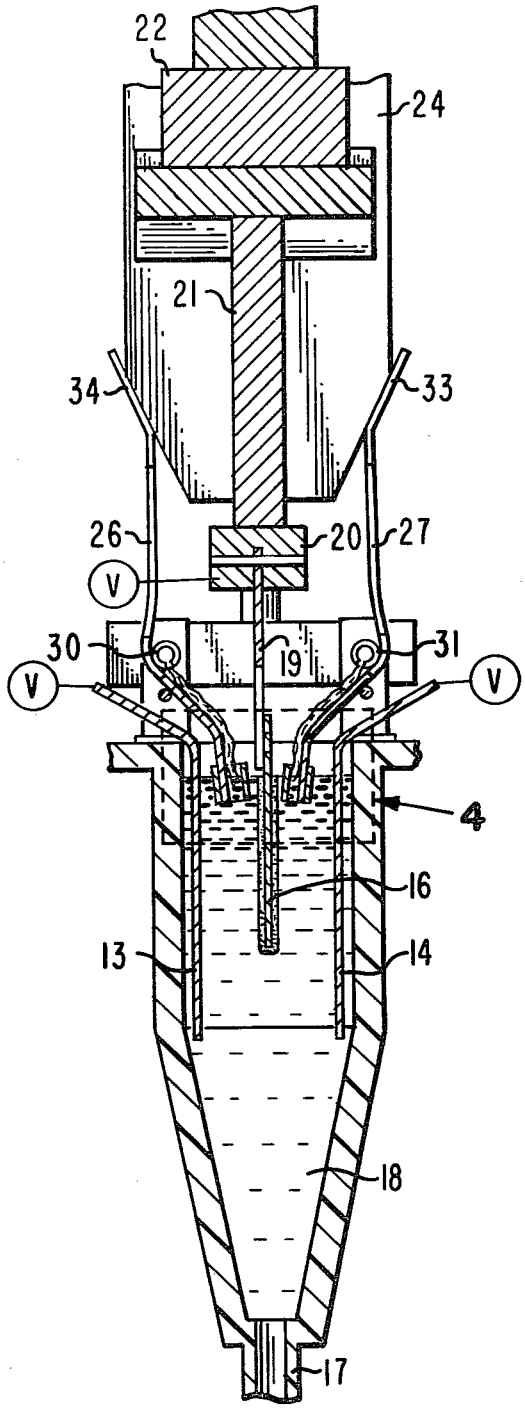
FIG. 2 is a cross-sectional illustration taken as indicated by the lines and arrows 2 on FIG. 1.
Figure 3:
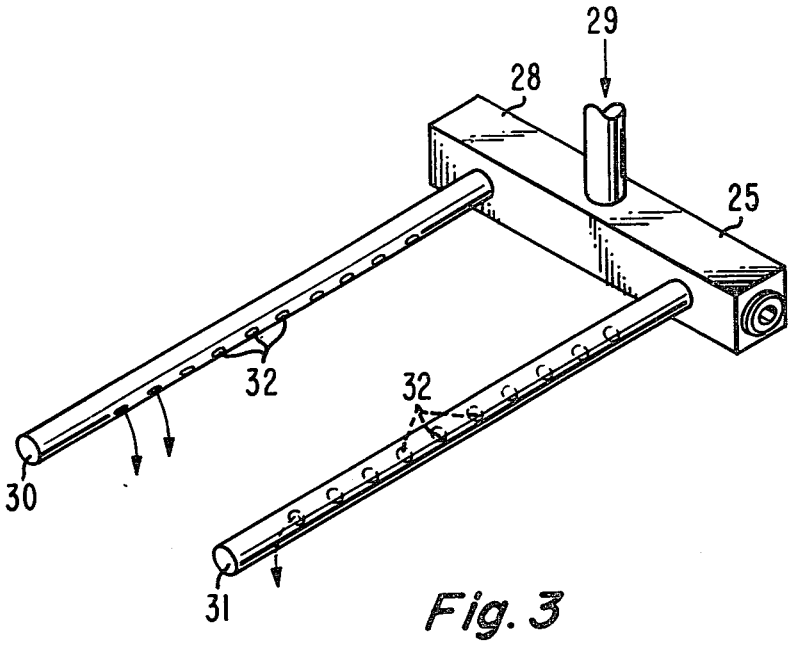
FIG. 3 is an isometric illustration of the manifold used in the distribution means of the apparatus of this invention.
Figure 4:
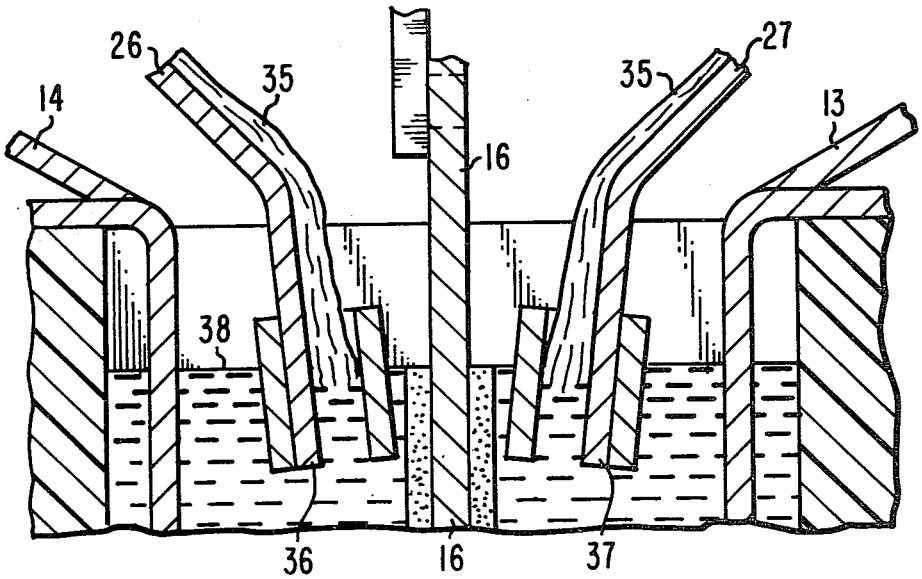
FIG. 4 is a cross-sectional illustration which is an enlargement of the area identified by the dotted line and arrow 4 on FIG. 2.

The electrophoretic deposition apparatus of this invention 10 is comprised of four principal parts, namely, the receiving tank 11, the article support assembly 12, the electrodes 13, 14, and the suspension distribution assembly 15 for introducing the suspension of the material to be deposited on the article 16 which is supported in the suspension.

The receiving tank 11 is preferably made of a dielectric material, such as plastic. The receiving tank 11 is of a somewhat elongated funnel shape, having deeply sloping walls and a drain port 17 at the base thereof. The receiving tank 11 is of a predetermined length and of a configuration so as to receive the electrodes 13, 14 and the article 16 to be coated into the interior thereof. The receiving tank 11 further has a reserve portion 18 in the lower portion thereof, which is below the lower edges of the electrodes 13, 14 and the article to be coated 16, which receives the settling supply of particles from the upper portion of the apparatus 10 of this invention.

The article support assembly 12 includes a plate 19 on which an article 16, such as a plate of sheet steel or the like, which is desired to be coated is directly hung in electrical contact with the plate 19. The plate 19 is then, in turn, held by a clamp 20. The clamp 20 is secured to a support shaft 21. A weight-measuring means 22 preferably is provided in connection with the shaft 21, so that the original weight of the article and the weight of the article with the coating applied can be accurately determined. The particular type of weight-control device is not critical, but it has been found to be preferable to use a strain-gauge-type device to obtain the desired degree of accuracy.

The entire article support assembly is movable in a vertical plane as indicated by the arrow 23, so that the article can be moved into and out of the suspension in the receiving tank 11.

The article support assembly 12 is connected to a source of voltage of a first polarity sufficient to cause the electrophoretic deposition of the coating on the article 16.

The article support assembly 12 further includes a cam plate 24, the function of which will be discussed in greater detail below with regard to the suspension distribution assembly 15.

A pair of electrode plates 13, 14 are secured in fixed position in the receiving tank 11. The electrode plates 13, 14 are attached to a source of voltage of a polarity which is opposite to that supplied to the article supported by the support assembly 12. The electrodes are made of a conductive metal, preferably a metal such as stainless steel. The electrode plates 13, 14 are spaced apart from each other and are positioned on opposite sides of the article 16 to be coated, so that both sides of the article 16 can be coated simultaneously. If only one surface of the article 16 is desired to be coated, only the electrode adjacent the desired surface to be coated on the article 16 would be activated. The zones between the electrodes 13, 14 and the article 16 are referred to as the electrophoretic zones, and it is in these zones where the flow of suspension should be as quiescent and laminar as possible.

The polarity of the voltage supplied to the article 16 supported by the article support means 12 and the polarity of the current supplied to the stationary electrodes 13, 14 and the potential can be changed if desired, as the particular polarity and potential are selected in accordance with the composition and chemical characteristics of the suspension which is to be used in the apparatus 10. The polarities and potential are selected so as to urge the particles from the suspension to be directed toward and become adhered to the article 16 suspended in the suspension.

The suspension distribution assembly 15 is comprised of a manifold 25 and a pair of guide plates 26, 27. The suspension which is the required composition is introduced into the apparatus 10 through an inlet pipe as indicated by the arrow 29. The suspension flows into the head box 28 where it is divided and is supplied to the discharge tubes 30, 31, which are in communication with the interior of the head box 28. Along the length of the discharge tubes 30, 31, there is provided a plurality of discharge orifices 32 through which the suspension exits.

Positioned immediately below the distribution tubes 30, 31 are the guide plates 26, 27, which may be fixed or movable. The guide plates are impervious plates which extend the length of the tank 11. The guide plates 26, 27, as illustrated, are pivotally mounted with the position of each guide plate 26, 27 being controlled by a cam follower 33, 34 which is in sliding camming engagement with the cam plate 24 attached to the article support means 12. When the article 16 is either being lowered into or raised out of the suspension in the receiving tank 11, the cam followers 33, 34 engage the cam plate 24 and are moved toward the walls of the receptacle so as to enlarge the opening into which and in which the article 16 is to be inserted or removed. This is an important optional feature of the apparatus of this invention 10 in that it prevents the accidental contact of the article being either introduced or removed from the bath with the guide plates 26, 27. It should be noted, however, that the guide plates 26, 27 can be fixed in position rather than being pivotally mounted to provide a fixed width area into which to insert or remove the article 16 without departing from the teaching of this invention.

The guide plates 26, 27 are positioned immediately below the exit orifices 32 in the distribution plates 30, 31, so that the supply of suspension provided from the manifold flows over the plates 26, 27 and toward the interior of the receiving tank 11 adjacent to the article 16 which is to be coated. The combination of the inlet distribution pipes and the arrangement of the holes 32 in the distribution pipes 30, 31 provides a uniform flow along the length of the tank 11, while the guide plates 26, 27 ensure that a smooth steady flow of the material is introduced into the receiving tank 11. At the terminal end of the guide plates 26, 27, at the point where they enter the suspension in the tank 11, there is provided open-bottom receptacles 36, 37, which have their bases open and immersed below the surface of the suspension and a raised wall extending above the surface of the suspension. When the suspension from the distribution pipes flows down the guide plates 26, 27, it flows into the chamber formed by the receptacles 36, 37 and under the upper surface of the suspension held in the tank 11, so as to cause a minimum of surface disturbance and turbulence adjacent the article 16 to be coated. Furthermore, the guide plates 26, 27 direct the flow of suspension in a downward laminar flow adjacent to and parallel to the surface of the article 16 to be coated, which is the preferred method of introducing the suspension into the bath.

In operation, the suspension of the material desired to be coated on the article 16 is initially prepared. A given concentration of finely divided particles of the material desired to be coated on the article 16 is suspended in a liquid medium, such as alcohol or water, with appropriate suspension agents and the like in the manner well-known in the art. This suspension is then introduced into the system and circulated by a pump so that it flows through the system. The flow pattern through the system consists of the suspension entering the apparatus through the manifold and then flowing through the manifold to the distribution pipes 30, 31 and out the holes 32 in the distribution pipes 30, 31. The suspension 35 as it flows from the distribution pipes 30, 31 flows over the guide plates 26, 27 wherein it is uniformly distributed. As the material flows down the guide plates 26, 27, it enters into the receptacles 36, 37 at the terminal end of the guide plates 26, 27 and is introduced below the level of the suspension in the tank so as not to produce surface turbulence immediately adjacent to the area in which the article 16 to be coated will be immersed. The suspension is constantly circulated through the apparatus by removing a portion of it through the bottom exit port 17 and returning to a reconstitution tank for adding additional particulate material to the suspension using well-known techniques in the art. Once a balance has been established with regard to the circulation of the suspension 35 through the apparatus 10, the article 16 to be coated, such as a sheet metal plate, is hung onto the article support assembly 12. The article support assembly 12 is then gradually lowered toward the bath. The cam followers 33, 34 in contact with the cam plate 24 in the upper position causes the guide plates 26, 27 to pivot open to provide a wider access for entrance of the article 16 into the suspension held in the receiving tank 11. As the part is lowered into the tank, the cam followers 33, 34 gradually move inwardly along the edge of the cam plate so as to move the guide plates 26, 27 inwardly and position the open-bottom receptacles 36, 37 on the terminal end of the guide plates 26, 27 adjacent to the article 16 to be coated. The initial weight of the article 16 is measured by the measuring device 22. The voltage is then supplied to the electrodes 13, 14 of a first polarity, while voltage of the opposite polarity is provided to the article 16 held by the article support assembly 12. Based on the amount of coating desired to be applied to the article 16, the weight of deposition is measured by the weight measuring means 22 until the desired amount of coating has been applied. When the desired amount of coating has been applied, the application of the voltage is discontinued and the process is reversed by gradually withdrawing the article 16 in a vertical direction with the article support means 12, whereupon the cam followers 33, 34 will again engage the cam plate 24 and move the guide plates 26, 27 out of position to facilitate the easy removal of the article 16 from the receiving tank 11.

It has been found that the apparatus of this invention is especially advantageous in achieving a smooth, laminar, uniform flow of glass particles in the suspensions employed in the electrophoretic deposition of glass or porcelain-forming particles on steel. Due to the relatively small amount of force which attracts the glass or porcelain-forming particles to deposit on the steel by electrophoresis, it is important that the liquid flow forces be small so as to allow the deposition to occur with a high degree of uniformity. Using the apparatus of this invention, it has been found that there is a minimal amount of movement of particles due to fluid-flow forces, which maximizes the distribution of the solids to the conductive surface of the article to be coated. The settling of the dense particles of liquid suspension and the overall settlement of materials from the suspension can readily be controlled by removing these from the enlarged bottom portion 18 of the tank without causing any significant turbulence in the tank 11. The guide plates 26, 27 likewise provide for a uniform flow of the suspension to the article 16, and also because in the preferred embodiment they are pivoted, they allow the easy entrance and removal of the article 16. The guide plates 26, 27 also allow the flow of the suspension to be released into the receiving tank 11 almost immediately adjacent the article 16 to be coated, thereby facilitating the laminar flow past the article 16 with a minimum of disturbance of the liquid on the surface.

The method of introducing and removing the suspension from the apparatus of this invention 10 provides an extremely quiescent introduction and a highly effective deposition of particulate materials on the article 16 to be coated and provides substantial advantages over the apparatus heretofore disclosed in the prior art.

We claim:

1. An apparatus for the electrophoretic deposition of material on an article comprised of:

(a) a tank of a predetermined length adapted to hold a suspension of the material in a liquid medium at a predetermined liquid level;

(b) first and second electrodes positioned within the interior of the tank in a parallel spaced-apart relationship to each other with each of said electrodes being adapted to receive a voltage of a first polarity;

(c) an article holder means for positioning and holding the article in a spaced-apart relationship from the first and second electrodes, said holder means further including means for providing a voltage of the opposite polarity to said first polarity to said article during electrophoretic deposition so as to form a first and a second electrophoretic zone between the first electrode and the article and the second electrode and the article, respectively;

(d) a distribution manifold means, said distribution manifold means including an inlet port for receiving a supply of the suspension and first and second discharge tubes, said discharge tubes being approximately said predetermined length of said tank and having a plurality of discharge apertures defined along the length thereof, said first discharge tubular member being positioned above the liquid level adjacent to the first electrophoretic zone, and said second tubular member being positioned above the liquid level adjacent the second electrophoretic zone; and (e) first and second flow guide means, said flow guide means being impervious longitudinal members of approximately said predetermined length, having an upper longitudinal edge and a lower longitudinal edge, the upper longitudinal edge of the first and second flow guides being positioned below the discharge apertures of the first and second tubular members, respectively, so that the suspension discharge from the apertures flows onto and down the surface of the first and second guide members, respectively, the lower longitudinal edge of said guide members being formed into an open-bottomed receptacle having a given wall height such that the receptacle on each of the flow guides can be partially submerged into the suspension below the liquid level, said first flow guide means being positioned with the open-bottomed receptacle in the suspension in the first electrophoretic zone and the second flow guide member being positioned with the open-bottomed receptacle in the second electrophoretic zone, whereby when suspension is introduced into said manifold distribution means, the suspension flows from the apertures in the tubular members, along the guide plates, and into the electrophoretic zones below the liquid level of the suspension held in the tank.

2. The apparatus according to claim 1 wherein the guide members are pivotally mounted for movement within the first and second electrophoretic zones.

3. The apparatus according to claim 2 wherein the flow guide means further include cam followers and said article holder means includes a cam which cooperates with the cam followers, whereby the position of the flow guides can be controlled by the cam on said sample holder.

4. The apparatus according to claim 1 wherein the article holder further includes means for weighing the sample during the electrophoretic deposition.

5. The apparatus according to claim 1 wherein the tank means further includes a bottom drain means, and the suspension removed from the bottom drain means is recirculated to the manifold means.

* * * * *